US008590974B2

(12) United States Patent
Kalayjian

(10) Patent No.: US 8,590,974 B2
(45) Date of Patent: Nov. 26, 2013

(54) ERGONOMIC KNEELING BENCH OR STOOL

(76) Inventor: Robert Kalayjian, Long Beach, CA (US)

( * ) Notice: Subject to any disclaimer, the term of this patent is extended or adjusted under 35 U.S.C. 154(b) by 134 days.

(21) Appl. No.: 13/247,676

(22) Filed: Sep. 28, 2011

(65) Prior Publication Data

US 2012/0074753 A1 Mar. 29, 2012

Related U.S. Application Data

(60) Provisional application No. 61/387,889, filed on Sep. 29, 2010.

(51) Int. Cl.
*A47C 7/50* (2006.01)
*A47C 7/52* (2006.01)

(52) U.S. Cl.
USPC ..... 297/423.11; 297/423.12

(58) Field of Classification Search
USPC ..... 297/423.11, 423.12
See application file for complete search history.

(56) References Cited

U.S. PATENT DOCUMENTS

| | | | | | |
|---|---|---|---|---|---|
| 2,631,652 | A | | 3/1953 | Bannister | |
| 3,541,313 | A | * | 11/1970 | Buzzi | 297/423.11 X |
| 3,669,493 | A | * | 6/1972 | Vowles | 297/423.11 |
| RE28,038 | E | * | 6/1974 | Buzzi | 297/423.11 X |
| 4,266,748 | A | | 5/1981 | Dalton | |
| 4,377,309 | A | | 3/1983 | Mengshoel | |
| 4,534,590 | A | * | 8/1985 | Yamamura et al. | 297/423.11 X |
| 4,589,699 | A | * | 5/1986 | Dungan | 297/423.12 |
| 4,676,547 | A | | 6/1987 | Spillman | |
| 4,700,914 | A | | 10/1987 | Chectham | |
| 4,772,071 | A | * | 9/1988 | Richards | 297/423.12 |
| 5,642,535 | A | * | 7/1997 | Frawley et al. | 4/559 |
| 5,865,507 | A | * | 2/1999 | Earl, Jr. | 297/423.11 |
| 5,882,081 | A | * | 3/1999 | Earl, Jr. | 297/423.11 |
| 5,927,797 | A | | 7/1999 | Ferguson | |
| 5,983,418 | A | * | 11/1999 | Goodman et al. | 297/423.11 X |
| 6,062,638 | A | | 5/2000 | Ferguson | |
| 6,997,513 | B2 | | 2/2006 | Ige et al. | |
| 7,086,702 | B1 | | 8/2006 | Hurt | |
| 8,465,099 | B2 | * | 6/2013 | Addy | 297/423.11 |
| 2003/0127900 | A1 | * | 7/2003 | Chen | 297/423.11 |
| 2005/0242630 | A1 | | 11/2005 | Miller | |
| 2006/0232007 | A1 | | 10/2006 | Kuehn | |
| 2011/0285188 | A1 | * | 11/2011 | Addy | 297/271.1 |

FOREIGN PATENT DOCUMENTS

| | | |
|---|---|---|
| CA | 2156979 | 2/1997 |
| DE | 29707882 | 10/1998 |
| FR | 2788088 | 7/2000 |
| GB | 2379383 | 3/2003 |

OTHER PUBLICATIONS

International Search Report, Feb. 21, 2012, 1 page.

* cited by examiner

*Primary Examiner* — Rodney B White
(74) *Attorney, Agent, or Firm* — Fulwider Patton LLP

(57) ABSTRACT

An ergonomic kneeling bench or stool for supporting weight of a user in a kneeling position includes a pedestal portion, and a seat portion having a generally central aperture that removably receives at least a portion of an end of the pedestal portion in an assembled configuration of the kneeling stool. The seat portion can include one or more permanent magnets, and the pedestal portion includes one or more corresponding permanent magnets, configured and aligned to magnetically attract each other and to releasably retain the seat portion and the pedestal portion together in either or both of unassembled and assembled configurations of the kneeling stool.

19 Claims, 6 Drawing Sheets

FIG. 1
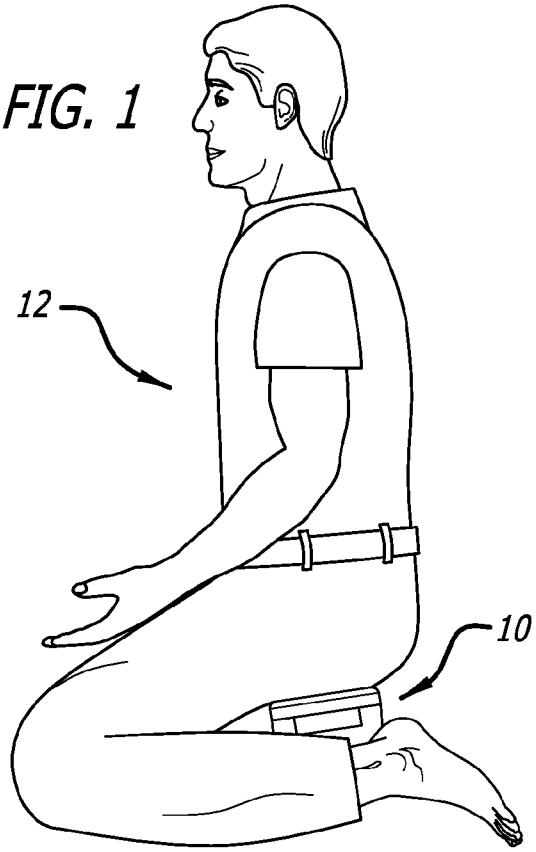
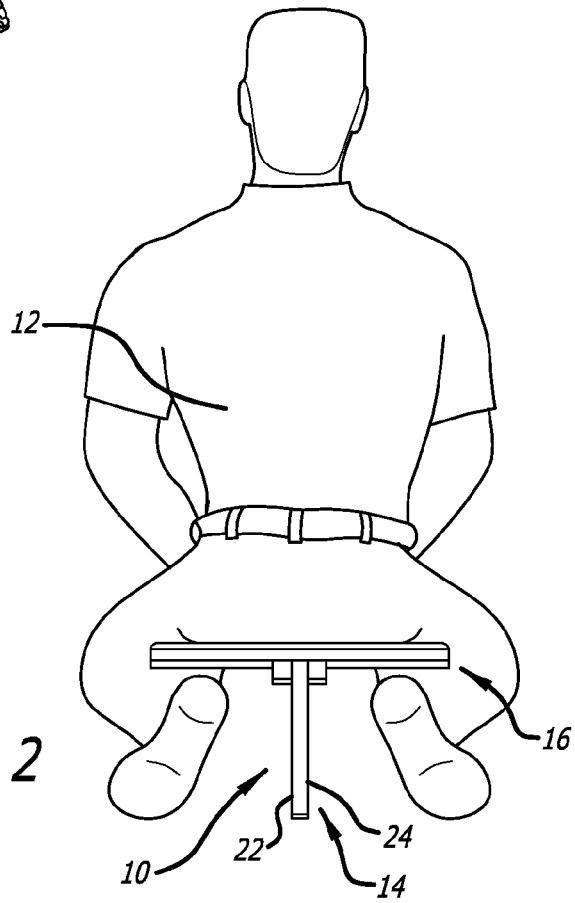
FIG. 2

ERGONOMIC KNEELING BENCH OR STOOL

CROSS-REFERENCE TO RELATED APPLICATIONS

This application is based upon and claims priority from provisional application No. 61/387,889, filed Sep. 29, 2010, which is incorporated in its entirety herein.

BACKGROUND OF THE INVENTION

The present invention relates generally to portable stools, and more particularly relates to collapsible kneeling stools.

Kneeling can be accomplished by resting on the either left knee or the right knee, or on both knees, such as during meditation or prayer, ceremonial events, watching sporting events, or the like. Benches or stools for supporting a portion of a user's weight in a kneeling position for extended periods of time can be useful in situations where a user needs to kneel for prolonged periods of time. While kneeling type chairs are known for use as an alternative to traditional chairs for use in a home or office, such kneeling type chairs are typically not lightweight or compact enough to be readily portable for use during meditation or prayer in out of the way locations such as gardens or in the wilderness, for example, or for watching sporting events such as at grass fields, such as for soccer or football, for example, where tiered stands or bleachers or other seating may not be available.

A portable milking stool is known that can be attached to the lower leg or ankle of a user, and can be positioned to support the weight of a user when the leg of the user on which the milking stool is attached is bent underneath the user. However, the milking stool is designed to be carried about while worn by a user on the user's lower leg, making the milking stool cumbersome for extended walking, and the milking stool is not conducive to supporting the weight of a user kneeling upon both knees.

A kneeling stool is also known that includes a frame to which ankle cushions and a seat are fixedly mounted, for supporting a user's ankles and feet, and for supporting a user's weight in a kneeling and sitting position. Another type of stool for supporting the weight of a user sitting at a low height above the ground is also known that includes a primary seating surface and a secondary, inwardly and downwardly sloped seating surface that curves around the primary seating surface. Another type of conventional compactable kneeling stool includes a base portion and a seat portion that is coupled to the base portion by a seat post. A pivot connection enables the seat post member to pivot with respect to the base portion, selectively adjusting a height dimension defined between the seat portion and the base portion to a desired pivot position about an axis defined by the pivot connection. While these stools are relatively smaller than traditional chairs for the home or office, they are still relatively bulky and cumbersome for a user to carry.

It would be desirable to provide an ergonomic and readily portable kneeling bench or stool that is lightweight and compact, and that is formed of a generally rectangular pedestal portion or base and a generally rectangular seat portion that can be combined in an assembled seat configuration to for supporting weight of a user kneeling on one or both knees, and that can be combined in a disassembled compact carrying configuration for storage or carrying by a user. The present invention meets these and other needs.

SUMMARY OF THE INVENTION

Briefly, and in general terms, the present invention provides for an ergonomic kneeling bench or stool for supporting weight of a user in a kneeling position. The ergonomic kneeling bench or stool includes a pedestal portion, and a seat portion having a generally central aperture that removably receives at least a portion of an end of the pedestal portion in an assembled configuration of the kneeling stool.

In one presently preferred aspect, the seat portion includes one or more permanent magnets, and the pedestal portion includes one or more corresponding permanent magnets, and the one or more permanent magnets of the seat portion and the one or more corresponding permanent magnets of the pedestal portion are configured and aligned to magnetically attract each other and to releasably retain the seat portion and the pedestal portion together in an unassembled configuration of the kneeling stool. In another presently preferred aspect, the one or more permanent magnets of the seat portion and the one or more corresponding permanent magnets of the pedestal portion are configured and aligned to magnetically attract each other and to releasably retain the seat portion and the pedestal portion together in an assembled configuration. In another presently preferred aspect, the seat portion includes a plurality of permanent magnets, and the pedestal portion includes a plurality of corresponding permanent magnets that cooperate to releasably retain the seat portion and the pedestal portion together in the assembled and unassembled configurations, respectively.

In another presently preferred aspect, the seat portion includes at least one bracket extending from a bottom side surface adjacent to the generally central aperture in the seat portion, and the pedestal portion includes an aperture therethrough configured to receive the at least one bracket of the bottom side surface of the seat portion, such that the one or more permanent magnets of the seat portion and the one or more corresponding permanent magnets of the pedestal portion cooperate in combination with the aperture in the pedestal portion and the at least one bracket on the bottom side surface of the seat portion to releasably retain the pedestal portion to the bottom side surface of the seat portion in the unassembled configuration of the kneeling stool. In a presently preferred aspect, the at least one bracket includes a plurality of post members.

In another presently preferred aspect, the one or more permanent magnets of the seat portion is mounted adjacent to the central aperture of the seat portion, and the one or more permanent magnets of the pedestal portion is mounted adjacent to a tongue portion of the pedestal portion, whereby the one or more permanent magnets of the seat portion and the one or more permanent magnets of the pedestal portion cooperate to releasably retain the tongue portion in the central aperture of the generally rectangular seat portion in the assembled configuration of the kneeling stool.

In another presently preferred aspect, the surface of the seat portion defines opposing seat shoulder support portions extending along the width of the seat portion substantially midway between opposing first and second longitudinal ends of the seat portion, the first longitudinal end of the pedestal portion includes first and second opposing side notch portions adjacent to first and second side edges of the pedestal portion forming first and second pedestal shoulder portions and a raised tongue end portion therebetween, and the central aperture of the seat portion removably receives the tongue end portion of the first longitudinal end, and the first and second pedestal shoulder portions support the opposing seat shoulder support portions of the seat portion in the assembled configuration. In another presently preferred aspect, the first and second shoulder portions and the tongue end portion of the pedestal portion extend at an oblique angle with respect to the second longitudinal end. In another presently preferred aspect, the pedestal portion has a generally rectangular shape with opposing first and second side edges, and the first side edge is shorter than the second side edge. In another presently preferred aspect, the second longitudinal end may have a planar surface or a rounded surface.

The compact, collapsible ergonomic kneeling stool or bench of the present invention is easily transportable in an unassembled configuration, and has a single leg or pedestal portion that can be inserted in an aperture of the bench or seat portion for use in an assembled configuration. The single leg or pedestal portion can be readily removed from the bench or seat portion an retained together with the bench or seat portion in an unassembled configuration for transport or storage. The kneeling stool or bench ergonomically supports and balances the spine of a user in multiple directions during use of the kneeling stool or bench in a kneeling position.

Other features and advantages of the present invention will become more apparent from the following detailed description of the preferred embodiments in conjunction with the accompanying drawings, which illustrate, by way of example, the operation of the invention.

BRIEF DESCRIPTION OF THE DRAWINGS

FIG. 1 is a side view showing a user resting on an ergonomic kneeling bench or stool according to the invention.

FIG. 2 is a rear view showing the user resting on the ergonomic kneeling bench or stool of FIG. 1.

DETAILED DESCRIPTION OF THE PREFERRED EMBODIMENTS

Figure 3:
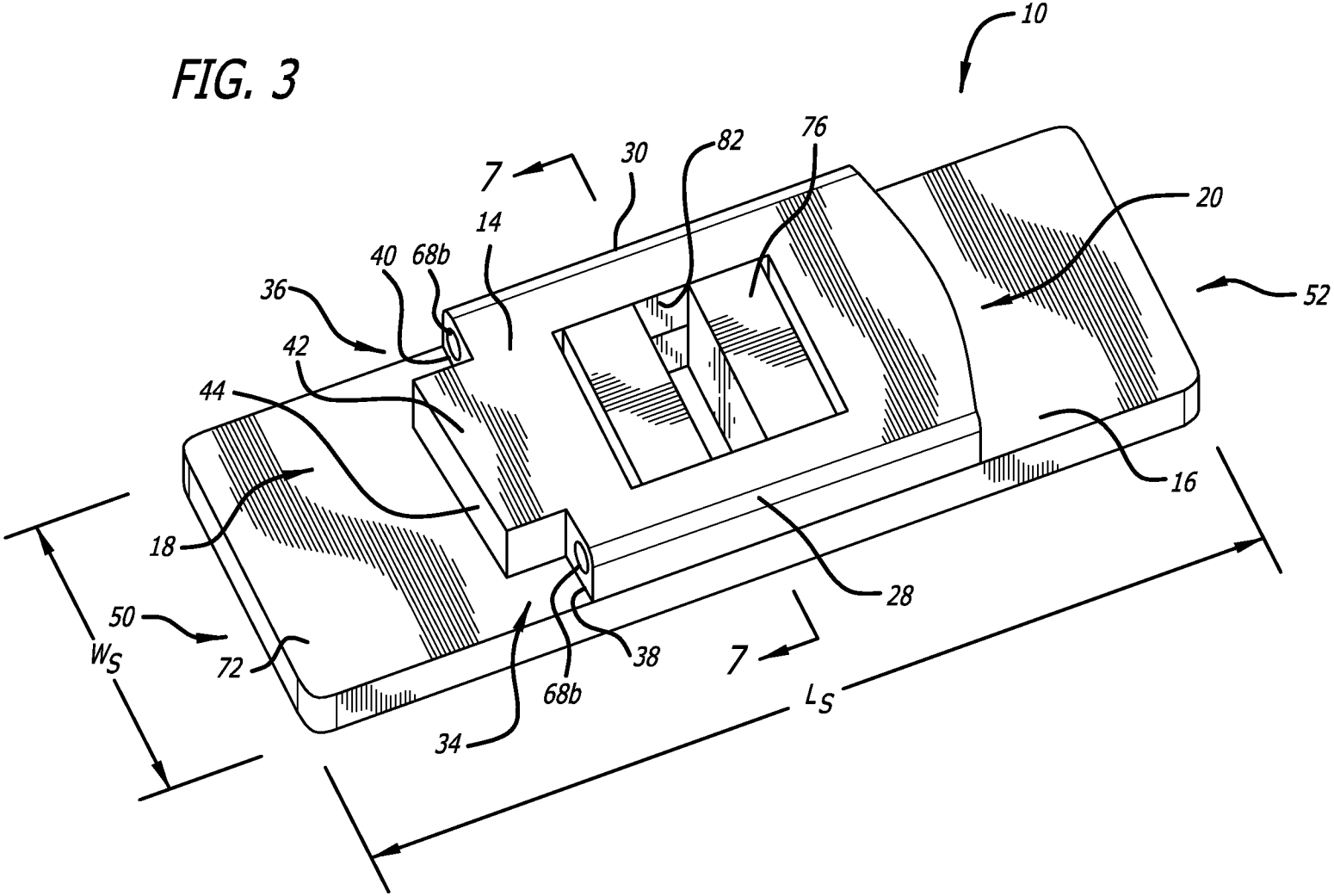
FIG. 3 is a perspective view of the ergonomic kneeling bench or stool of FIG. 1 in an unassembled configuration.
Figure 4:
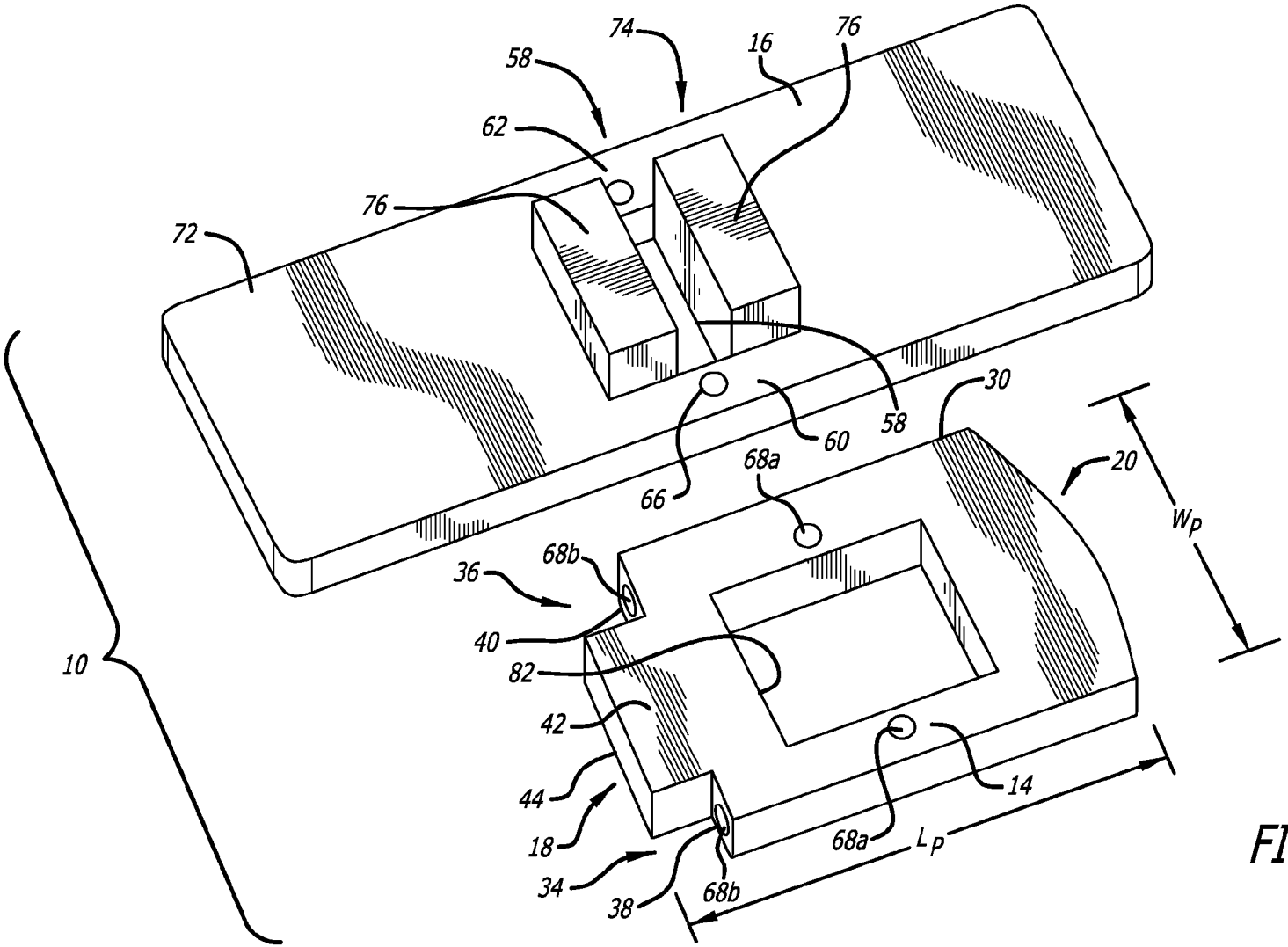
FIG. 4 is an exploded view of the ergonomic kneeling bench or stool of FIG. 1 in an unassembled configuration.
Figure 5:
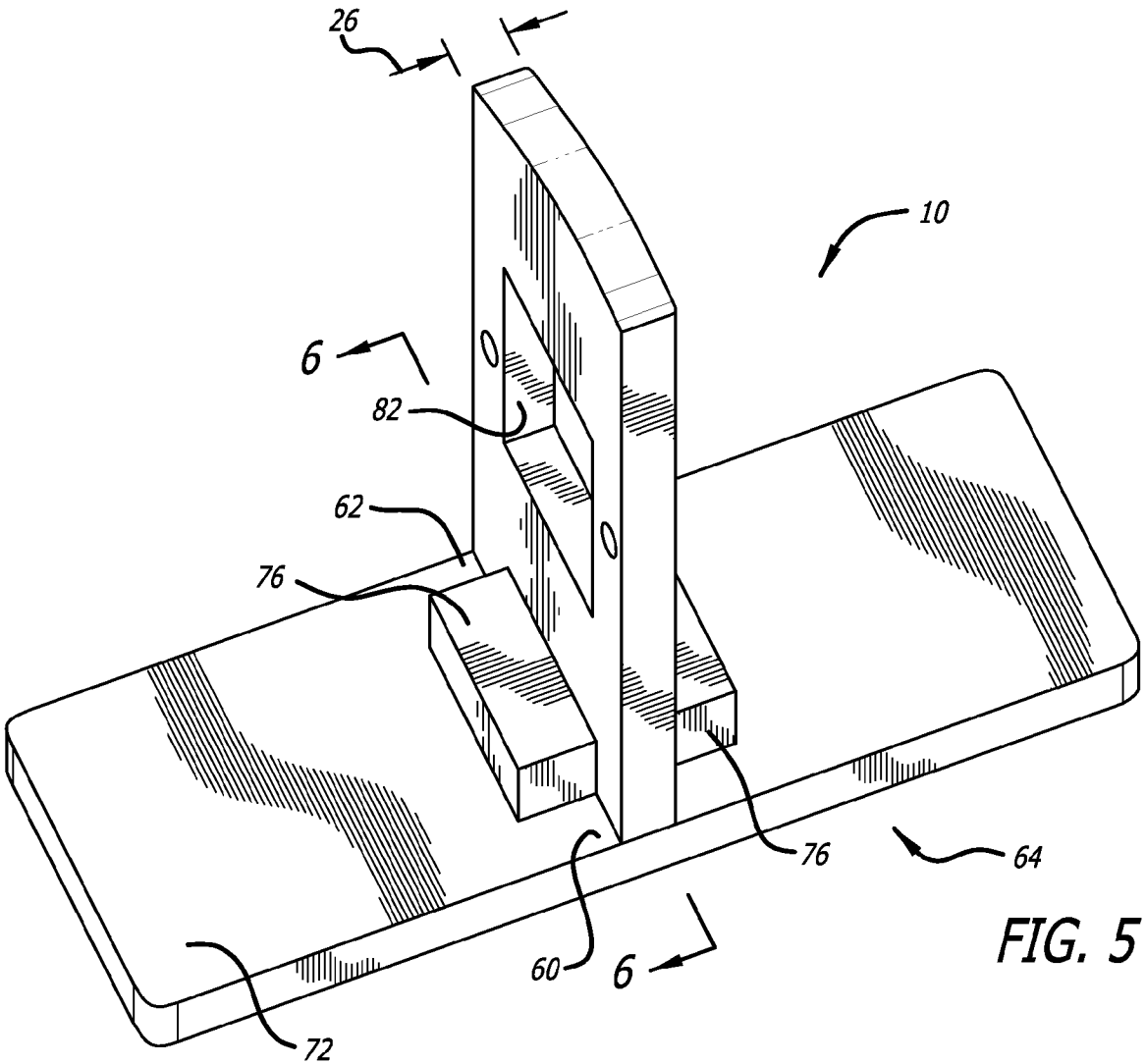
FIG. 5 is a perspective view of the ergonomic kneeling bench or stool of FIG. 1 in an assembled configuration.
Figure 6:
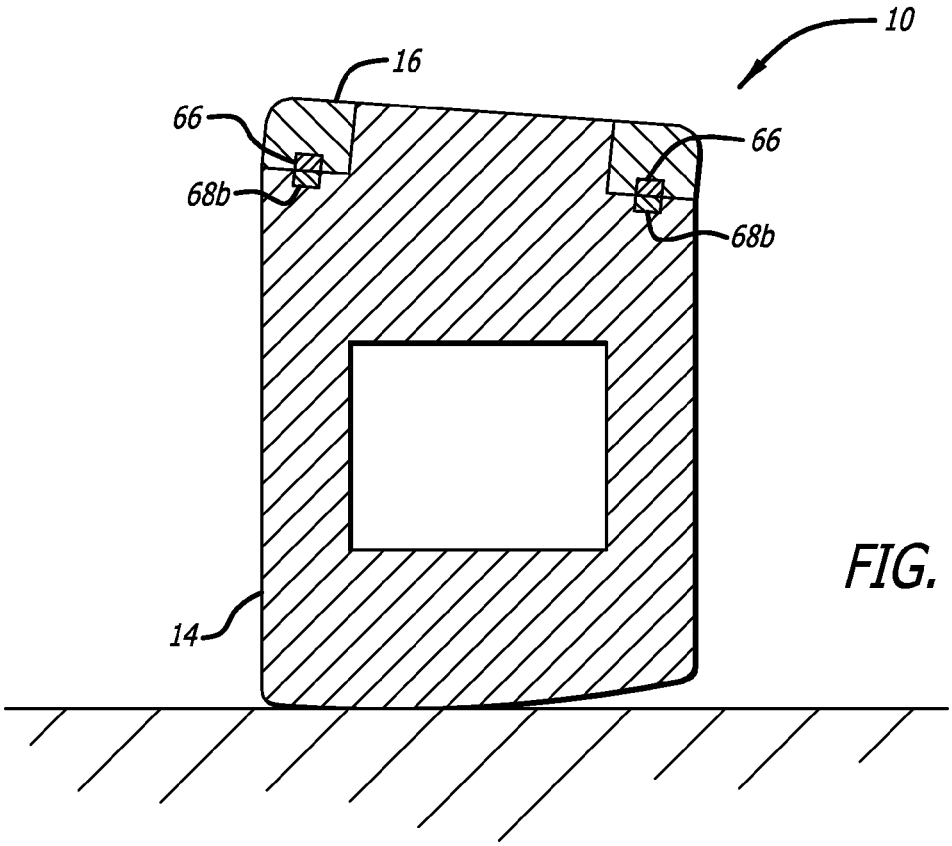
FIG. 6 is a cross-sectional view of the ergonomic kneeling bench or stool taken along line 6-6 of FIG. 5.
Figure 7:
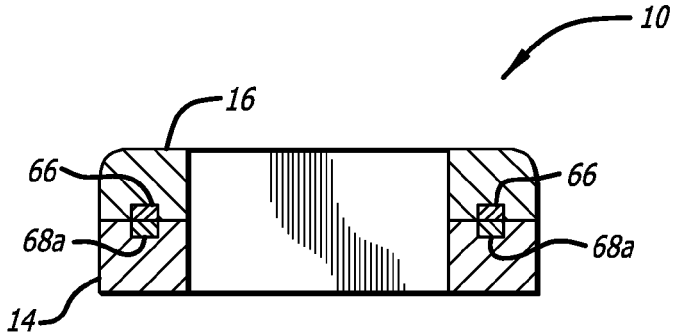
FIG. 7 is a cross-sectional view of the ergonomic kneeling bench or stool taken along line 7-7 of FIG. 3.

Referring to the drawings, which are provided by way of example, and not by way of limitation, the present invention provides for a compact, collapsible ergonomic kneeling stool or bench 10 for a person 12, for supporting at least a portion of a user's weight sitting upon the kneeling stool or bench while in a kneeling position, such as with one or both knees resting upon a floor, ground or other supporting platform, for example. The kneeling stool or bench of the invention can be used in any situation where prolonged seated kneeling is required, such as during meditation or prayer, watching sporting events, or during similar activities in which a person may need to assume a kneeling position for a lengthy period of time. The kneeling stool or bench includes a single centered leg or pedestal 14 that is typically generally rectangular, and a bench or seat portion 16 that is also typically generally rectangular. The centered leg or pedestal portion and the bench or seat portion both can be produced from a variety of materials, such as wood, plastic or metal, or the like. The size of the kneeling stool or bench can be increased, and the leg or pedestal length can be varied for larger persons, or for use like a chair or stool by a user sitting with one or both feet in front on a floor, ground or other supporting platform, for example.

The generally rectangular pedestal has a length $L_P$ along a longitudinal dimension and a width $W_P$ along a main transverse dimension perpendicular to the longitudinal dimension, opposing first and second longitudinal ends 18, 20, opposing first and second opposing parallel main sides 22, 24 along the main transverse dimension and having a side edge width 26, and opposing first and second side edges 28, 30. The single centered leg or pedestal is typically about 6-14 inches high and substantially equal in width to the width of the bench or seat portion, for example. The bench or seat portion is typically about 6-8 inches wide and 12-18 inches long, for example. Each of the opposing first and second side edges typically has a side edge width narrower than the main pedestal width, and the first side edge is typically shorter than the second side edge, so that the leg or pedestal typically establishes a forward leaning angle of the kneeling stool or bench in an assembled configuration during use on the ground or other platform surface of between about 7 and 15 degrees. As will be explained further herein after, the leg or pedestal typically may be planar, or may have a rounded bottom end to allow the user to adjust the otherwise fixed angle plus-or-minus 1-2 degrees.

The first longitudinal end of the single centered leg or pedestal also typically includes first and second opposing side notch portions 34, 36 adjacent to the first and second side edges, so that the first and second opposing side notch portions form first and second shoulder portions 38, 40, and a raised tongue portion 42 therebetween with a tongue end portion 44. The first and second shoulder portions and the tongue end portion typically are canted to extend at an oblique angle with respect to the second longitudinal end. In a presently preferred aspect, the second longitudinal end which serves as the base of the pedestal has a rounded surface so that a user can slightly modify the angle of the seat portion with respect to the ground or other platform upon which the base of the pedestal of the kneeling stool will rest during use in an assembled configuration, although the second longitudinal end may have a planar surface.

The generally rectangular bench seat portion typically has opposing first and second longitudinal ends 50, 52, with a length $L_S$ therebetween, and opposing first and second side edges defining a width $W_S$ therebetween. The generally rectangular seat portion also preferably has a surface that defines a generally central aperture 58 and a pair of opposing shoulder support portions 60, 62 extending along the width of the seat portion, preferably substantially midway between the opposing first and second longitudinal ends of the generally rectangular seat portion. The central aperture of the generally rectangular seat portion is configured to removably receive the raised tongue portion of the first longitudinal end of the pedestal in an assembled configuration 64 of the kneeling stool, and the first and second shoulder portions of the generally rectangular pedestal are configured to support the opposing shoulder support portions of the generally rectangular seat portion in the assembled configuration of the kneeling stool.

In another presently preferred aspect, the centered leg or pedestal can be held in place with permanent magnets, such as powerful rare earth magnets, for example, strategically mounted to the centered leg or pedestal portion and the bench or seat portion, in either or both of the assembled, operating configuration and the unassembled, collapsed portable configuration. In a currently preferred embodiment, the generally rectangular seat portion may include one or more permanent magnets 66, typically a plurality of permanent magnets that are typically mounted to the shoulder support portions of the bench or seat portion, and the generally rectangular pedestal may include one or more permanent magnets 68*a*, 68*b*, typically a plurality of permanent magnets, that can be configured to be aligned and oriented to attract corresponding ones of the one or more permanent magnets in the generally rectangular seat portion to releasably retain or secure the pedestal portion and the seat portion together flat against each other when the kneeling stool is in at least one of the assembled configuration and the unassembled configuration. Alternatively or in addition, as is illustrated in FIG. 9, the pedestal portion and the seat portion can be releasably retained or secured together flat against each other in the unassembled configuration by other types of fasteners, such as hook and loop fasteners, a belt or strap, elastic band, or the like.

In another presently preferred aspect, the generally rectangular seat portion has a top side surface, and a bottom side surface 72, and the generally rectangular seat portion includes one or more brackets 74, such as a plurality of post members 76, extending from the bottom side surface of the generally rectangular seat portion on opposing sides of the central aperture in the generally rectangular seat portion, and the generally rectangular pedestal includes an aperture 82 therethrough configured to receive the one or more brackets extending from the bottom side surface of the generally rectangular seat portion. Typically a pair of permanent magnets 68*a* can be mounted to one of the first and second opposing parallel main sides of the leg or pedestal on opposing sides of the pedestal aperture. The one or more permanent magnets of the generally rectangular pedestal and the one or more permanent magnets of the generally rectangular seat portion cooperate in combination with the aperture in the generally rectangular pedestal and the one or more brackets or posts extending from the bottom side surface of the generally rectangular seat portion to releasably retain or secure the generally rectangular pedestal to the bottom side surface of the generally rectangular seat portion in the unassembled configuration of the kneeling stool.

In another presently preferred aspect, either as an alternative or in addition to the permanent magnets 68*a*, typically a pair of magnets 68*b* can be mounted to the first longitudinal end of the leg or pedestal at the first and second shoulder portions or in the notched portions on either side of the raised tongue portion of the leg or pedestal. The one or more permanent magnets 68*b* of the generally rectangular pedestal and the one or more permanent magnets of the generally rectangular seat portion can be configured to magnetically attract each other and to retain the generally rectangular seat portion and the generally rectangular pedestal together in the assembled configuration of the kneeling stool with the tongue end portion of the leg or pedestal inserted in the generally central aperture of the bench or seat portion. The one or more permanent magnets of the generally rectangular seat portion mounted to the generally rectangular seat portion adjacent to the central aperture of the generally rectangular seat portion and the one or more permanent magnets of the generally rectangular pedestal mounted to the generally rectangular pedestal adjacent to the tongue portion of the generally rectangular pedestal can thus cooperate to releasably retain or secure the tongue portion in the central aperture of the generally rectangular seat portion in the assembled configuration of the kneeling stool.

Figure 8:
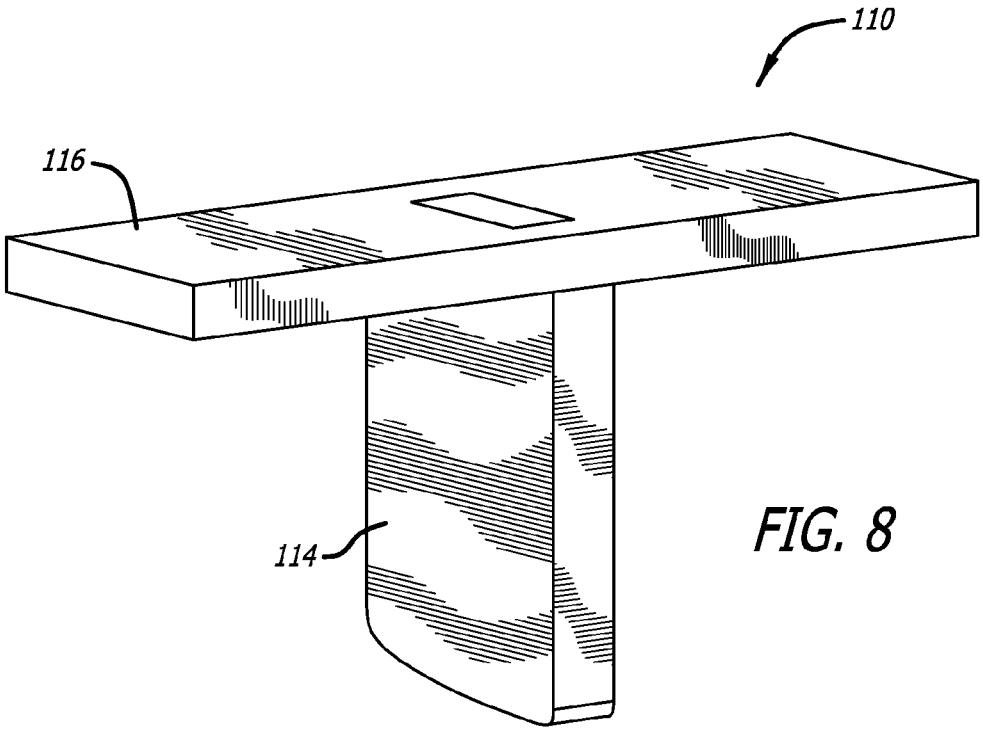
FIG. 8 is a perspective view of a variation of the ergonomic kneeling bench or stool of the invention in an assembled configuration.
Figure 9:
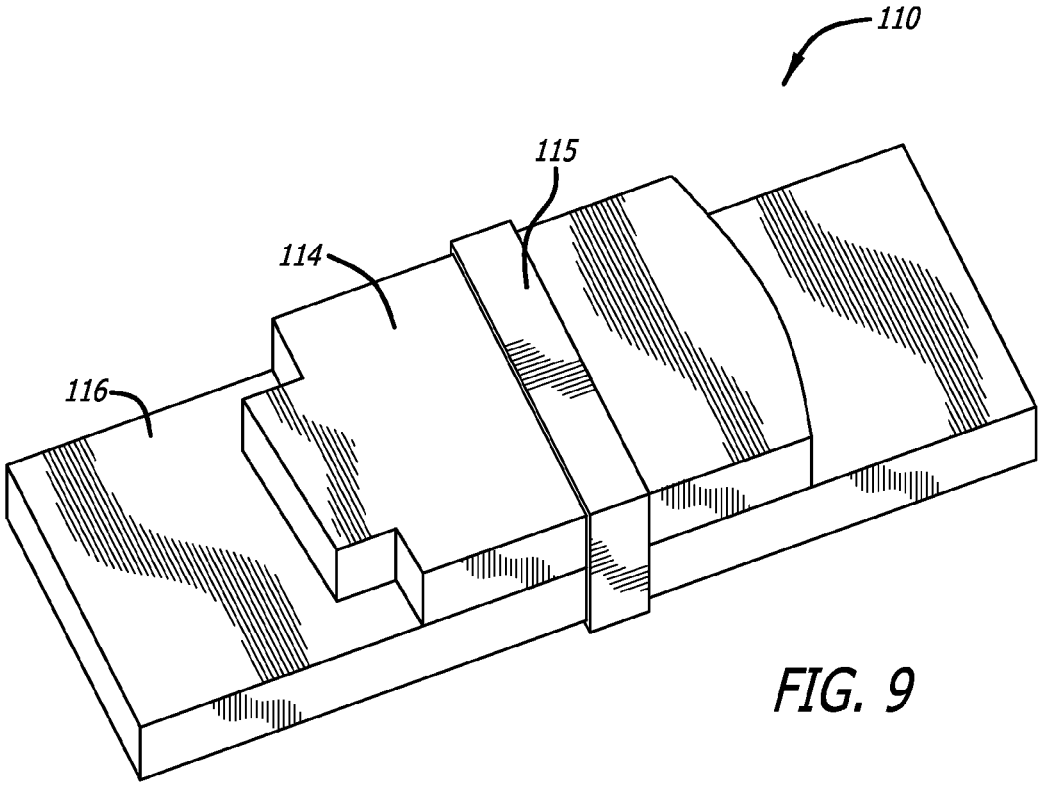
FIG. 9 is a perspective view of the ergonomic kneeling bench or stool of FIG. 8 in an unassembled configuration.

Referring to FIGS. 8-9, in one variation, the present invention provides for a compact, collapsible ergonomic kneeling stool or bench 110 for a person (not shown) for supporting at least a portion of a user's weight sitting upon the kneeling stool or bench while in a kneeling position, as described above. The kneeling stool or bench includes a single centered leg or pedestal 114 that is typically generally rectangular, and a bench or seat portion 116 that is also typically generally rectangular. The centered leg or pedestal portion and the bench or seat portion both can be produced from a variety of materials, such as wood, plastic or metal, or the like.

The generally rectangular pedestal has a length along a longitudinal dimension and a width along a main transverse dimension perpendicular to the longitudinal dimension, opposing first and second longitudinal ends, opposing first and second opposing parallel main sides along the main transverse dimension, and having a side edge width, and opposing first and second side edges. The leg or pedestal typically establishes a forward leaning angle of the kneeling stool or bench in an assembled configuration during use on the ground or other platform surface of between about 7 and 15 degrees.

The first longitudinal end of the single centered leg or pedestal also typically includes first and second opposing side notch portions adjacent to the first and second side edges, so that the first and second opposing side notch portions form first and second shoulder portions, and a raised tongue portion therebetween with a tongue end portion. The first and second shoulder portions and the tongue end portion can be canted to extend at an oblique angle with respect to the second longitudinal end. The surface of the second longitudinal end or base of the leg or pedestal currently preferably has a rounded bottom end to allow the user to slightly modify the angle of the seat portion with respect to the ground or other platform upon which the base of the pedestal of the kneeling stool will rest during use in an assembled configuration, although the second longitudinal end may have a planar surface to provide a fixed angle of the seat portion with respect to the ground or other platform.

The generally rectangular bench seat portion typically has opposing first and second longitudinal ends, with a length therebetween, and opposing first and second side edges defining a width therebetween. The generally rectangular seat portion also preferably has a surface that defines a generally central aperture, preferably substantially midway between the opposing first and second longitudinal ends of the generally rectangular seat portion. The central aperture of the generally rectangular seat portion is configured to removably receive the raised tongue portion of the first longitudinal end of the pedestal in an assembled configuration of the kneeling stool, and the first and second shoulder portions of the generally rectangular pedestal are configured to support the opposing shoulder support portions of the generally rectangular seat portion in the assembled configuration of the kneeling stool. As is illustrated in FIG. 9, the pedestal portion and the seat portion can be releasably retained or secured together, i.e. flat against each other, in the unassembled configuration by one or more fasteners, such as a belt or strap 115, an elastic band, or hook and loop fasteners, or the like.

It will be apparent from the foregoing that while particular forms of the invention have been illustrated and described, various modifications can be made without departing from the spirit and scope of the invention. Accordingly, it is not intended that the invention be limited, except as by the appended claims.

I claim:

1. A kneeling stool for supporting a user, comprising:

a generally rectangular pedestal having a length along a longitudinal dimension and a width, opposing first and second longitudinal ends, opposing first and second sides along said width, and opposing first and second side edges; and a generally rectangular seat portion having opposing first and second longitudinal ends and a length therebetween, opposing first and second side edges defining a width therebetween, and a seat surface defining a central aperture removably receiving at least a portion of said first longitudinal end in an assembled configuration of the kneeling stool, wherein said seat surface defines opposing shoulder support seat portions extending along said width of said generally rectangular seat portion substantially midway between said opposing first and second longitudinal ends of said generally rectangular seat portion, said first longitudinal end of said generally rectangular pedestal includes first and second opposing side notch portions adjacent to said first and second side edges forming first and second pedestal shoulder portions and a raised tongue end portion therebetween, said central aperture of said generally rectangular seat portion removably receiving said tongue end portion of said first longitudinal end and said first and second pedestal shoulder portions supporting said opposing shoulder support seat portions of said generally rectangular seat portion in said assembled configuration of the kneeling stool.

2. The kneeling stool of claim 1, wherein said first side edge is shorter than said second side edge.

3. The kneeling stool of claim 1, wherein first and second shoulder portions and said tongue end portion extend at an oblique angle with respect to said second longitudinal end.

4. The kneeling stool of claim 1, wherein said second longitudinal end has a planar surface.

5. A kneeling stool for supporting a user, comprising:

a generally rectangular pedestal having a length along a longitudinal dimension and a width, opposing first and second longitudinal ends, opposing first and second sides along said width, and opposing first and second side edges; and a generally rectangular seat portion having opposing first and second longitudinal ends and a length therebetween, opposing first and second side edges defining a width therebetween, and a seat surface defining a central aperture removably receiving at least a portion of said first longitudinal end in an assembled configuration of the kneeling stool, wherein said second longitudinal end has a rounded surface.

6. A kneeling stool for supporting a user, comprising:

a generally rectangular pedestal having a length along a longitudinal dimension and a width, opposing first and second longitudinal ends, opposing first and second sides along said width, and opposing first and second side edges; and a generally rectangular seat portion having opposing first and second longitudinal ends and a length therebetween, opposing first and second side edges defining a width therebetween, and a seat surface defining a central aperture removably receiving at least a portion of said first longitudinal end in an assembled configuration of the kneeling stool, wherein said generally rectangular seat portion includes at least one permanent magnet, and said generally rectangular pedestal includes at least one corresponding permanent magnet, said at least one permanent magnet of said generally rectangular seat portion and said at least one corresponding permanent magnet of said generally rectangular pedestal being configured and aligned to magnetically attract each other and to releasably retain said generally rectangular seat portion and said generally rectangular pedestal together in an unassembled configuration of the kneeling stool.

7. The kneeling stool of claim 6, wherein said at least one permanent magnet of said generally rectangular seat portion and said at least one corresponding permanent magnet of said generally rectangular pedestal comprise a plurality of permanent magnets of said generally rectangular seat portion a plurality of corresponding permanent magnets of said generally rectangular pedestal, respectively.

8. The kneeling stool of claim 6, wherein said generally rectangular seat portion has a top side surface and a bottom side surface, and said generally rectangular seat portion includes at least one bracket extending from said bottom side surface of said generally rectangular seat portion on opposing sides of said central aperture in said generally rectangular seat portion, and said generally rectangular pedestal includes an aperture therethrough configured to receive said at least one bracket extending from said bottom side surface of said generally rectangular seat portion, said at least one permanent magnet of said generally rectangular seat portion and said at least one corresponding permanent magnet of said generally rectangular pedestal cooperating in combination with said aperture in said generally rectangular pedestal and said at least one bracket extending from said bottom side surface of said generally rectangular seat portion to releasably retain said generally rectangular pedestal to said bottom side surface of said generally rectangular seat portion in said unassembled configuration of the kneeling stool.

9. The kneeling stool of claim 8, wherein at least one bracket comprises a plurality of post members.

10. The kneeling stool of claim 1, wherein said generally rectangular seat portion includes at least one permanent magnet, and said generally rectangular pedestal includes at least one corresponding permanent magnet, said at least one permanent magnet of said generally rectangular seat portion and said at least one corresponding permanent magnet of said generally rectangular pedestal being configured and aligned to magnetically attract each other and to releasably retain said generally rectangular seat portion and said generally rectangular pedestal together in said assembled configuration of the kneeling stool.

11. The kneeling stool of claim 10, wherein said at least one permanent magnet of said generally rectangular seat portion and said at least one corresponding permanent magnet of said generally rectangular pedestal comprise a plurality of permanent magnets of said generally rectangular seat portion a plurality of corresponding permanent magnets of said generally rectangular pedestal, respectively.

12. The kneeling stool of claim 10, wherein said at least one permanent magnet of said generally rectangular seat portion is mounted to said generally rectangular seat portion adjacent to said central aperture of said generally rectangular seat portion, and said at least one permanent magnet of said generally rectangular pedestal is mounted to said generally rectangular pedestal adjacent to said tongue portion of said generally rectangular pedestal, whereby said at least one permanent magnet of said generally rectangular seat portion and said at least one permanent magnet of said generally rectangular pedestal are operative to releasably retain said tongue portion in said central aperture of said generally rectangular seat portion in said assembled configuration of the kneeling stool.

13. A kneeling stool for supporting a user, the kneeling stool having an assembled configuration and an unassembled configuration, comprising:

a generally rectangular pedestal having a length along a longitudinal dimension and a width, opposing first and second longitudinal ends, opposing first and second sides along said width, and opposing first and second side edges;

a generally rectangular seat portion having opposing first and second longitudinal ends and a length therebetween, opposing first and second side edges defining a width therebetween, and a seat surface defining a central aperture removably receiving at least a portion of said first longitudinal end in the assembled configuration of the kneeling stool; and a plurality of permanent magnets mounted to said generally rectangular seat portion, and a plurality of corresponding permanent magnets mounted to said generally rectangular pedestal, respectively, said plurality of permanent magnets mounted to said generally rectangular seat portion and said plurality of corresponding permanent magnets mounted to said generally rectangular pedestal being configured and aligned to magnetically attract each other and to releasably secure said generally rectangular seat portion and said generally rectangular pedestal together in the unassembled configuration of the kneeling stool, and said plurality of permanent magnets mounted to said generally rectangular seat portion and said plurality of corresponding permanent magnets mounted to said generally rectangular pedestal being configured and aligned to magnetically attract each other and to releasably secure said generally rectangular seat portion and said generally rectangular pedestal together in the assembled configuration of the kneeling stool.

14. The kneeling stool of claim 13, wherein said seat surface defines opposing shoulder support seat portions extending along said width of said generally rectangular seat portion substantially midway between said opposing first and second longitudinal ends of said generally rectangular seat portion, said first longitudinal end of said generally rectangular pedestal includes first and second opposing side notch portions adjacent to said first and second side edges forming first and second pedestal shoulder portions and a raised tongue end portion therebetween, said central aperture of said generally rectangular seat portion removably receiving said tongue end portion of said first longitudinal end, and wherein said first and second shoulder portions of said generally rectangular pedestal are configured to support said opposing shoulder support portions of said generally rectangular seat portion in said assembled configuration of the kneeling stool.

15. The kneeling stool of claim 14, wherein first and second shoulder portions and said tongue end portion extend at an oblique angle with respect to said second longitudinal end.

16. The kneeling stool of claim 13, wherein said second longitudinal end has a planar surface.

17. The kneeling stool of claim 13, wherein said second longitudinal end has a rounded surface.

18. The kneeling stool of claim 13, wherein said generally rectangular seat portion has a top side surface and a bottom side surface, and said generally rectangular seat portion includes a plurality of post members extending from said bottom side surface of said generally rectangular seat portion on opposing sides of said central aperture in said generally rectangular seat portion, and said generally rectangular pedestal includes an aperture therethrough configured to receive said a plurality of post members extending from said bottom side surface of said generally rectangular seat portion, said plurality of permanent magnets mounted to said generally rectangular seat portion and said plurality of corresponding permanent magnets mounted to said generally rectangular pedestal cooperating in combination with said aperture in said generally rectangular pedestal and said plurality of post members extending from said bottom side surface of said generally rectangular seat portion to releasably secure said generally rectangular pedestal to said bottom side surface of said generally rectangular seat portion in the unassembled configuration of the kneeling stool.

19. The kneeling stool of claim 13, wherein said plurality of permanent magnets of said generally rectangular seat portion are mounted to said generally rectangular seat portion adjacent to said central aperture of said generally rectangular seat portion, and said plurality of corresponding permanent magnets of said generally rectangular pedestal are mounted to said generally rectangular pedestal adjacent to said tongue portion of said generally rectangular pedestal, whereby said plurality of permanent magnets of said generally rectangular seat portion and said plurality of corresponding permanent magnets of said generally rectangular pedestal cooperate to releasably secure said tongue portion in said central aperture of said generally rectangular seat portion in said assembled configuration of the kneeling stool.

* * * * *